US006639496B1

(12) United States Patent
van Namen

(10) Patent No.: US 6,639,496 B1
(45) Date of Patent: Oct. 28, 2003

(54) BISTABLE LONG-STROKE ELECTRO-MAGNETIC MECHANICAL ACTUATOR

(76) Inventor: Frederik T. van Namen, 25570 Serena Dr., Valencia, CA (US) 91355

( * ) Notice: Subject to any disclaimer, the term of this patent is extended or adjusted under 35 U.S.C. 154(b) by 0 days.

(21) Appl. No.: 10/313,843

(22) Filed: Dec. 9, 2002

Related U.S. Application Data

(63) Continuation-in-part of application No. 09/843,478, filed on Apr. 25, 2001, now Pat. No. 6,512,435.

(51) Int. Cl.[7] ..... H01F 7/00; H01F 7/08
(52) U.S. Cl. ..... 335/234; 335/229
(58) Field of Search ..... 335/229–234, 335/255, 281

(56) References Cited

U.S. PATENT DOCUMENTS 5,405,050 A * 4/1995 Walsh ..... 222/1
5,434,549 A * 7/1995 Hirabayashi et al. ..... 335/229
5,883,557 A * 3/1999 Pawlak et al. ..... 335/179
6,028,499 A * 2/2000 Oudet et al. ..... 335/220

* cited by examiner

*Primary Examiner*—Ramon M. Barrera
(74) *Attorney, Agent, or Firm*—J. E. McTaggart

(57) ABSTRACT

A novel bistable actuator of the coaxial plunger type, requiring only a single electrical coil and a single permanent magnet, provides electrical remote control of extension and retraction of a locking pin in an usually long linear bidirectional power stroke whose two end positions are held stable magnetically to withstand environmental acceleration as required for missile or aerospace component locking requirements. The coil is located in a cylindrical soft iron stator shell that acts as a magnetic yoke handling the flux loop from the permanent magnet which, fitted with circular end pole plates, forms a moving armature/plunger driving the locking pin. The working magnetic air gap dimension and flux density remain substantially constant over a major central portion of the stroke so that the actuator is driven uniformly in the mode of a speaker voice coil. The magnetic holding force at the stroke ends can be independently adjusted in design.

4 Claims, 2 Drawing Sheets

BISTABLE LONG-STROKE ELECTRO-MAGNETIC MECHANICAL ACTUATOR

The present application is a continuation-in-part of allowed U.S. patent application Ser. No. 09/843,478, filed Apr. 25, 2001 now U.S. Pat. No. 6,512,435, which is incorporated herein by reference.

FIELD OF THE INVENTION

The present invention relates to the field of electromagnetic mechanical actuators and more particularly it relates to an actuator that provides an usually long powered stroke for toggling between two unpowered but positively stabilized stroke-end positions, suitable for locking movable components in place by remote control as frequently required in defense ordnance including missiles and other aerospace craft as well as in ground vehicles, marine vessels and in many kinds of buildings such as residential, industrial, and commercial.

BACKGROUND OF THE INVENTION

Usage of electromagnetic actuators has continuously expanded as part of the overall technological advancement of communications, electronics, aerospace and defense ordnance of all kinds including missiles. Such actuators play a key role in a wide variety of present day equipment, especially remotely controllable mechanisms in vehicles, spacecraft, aircraft, missiles, boats, ground equipment, public, commercial and residential buildings, garages or parking areas, etc.

The class of electrically powered actuators that are addressed in the field of the present invention are structured coaxially with a central moving core, sometimes referred to as an armature or plunger, mechanically linked to a load: in the present instance the moving armature is extended at one end to form a retractable locking pin. Typically the unit is powered by D.C. e.g. from a 12 volt battery. The unit must be capable of actuation in two opposite directions, and, at either end of the stroke, must remain substantially constrained without consuming any holding power, since locks or locking devices are often left unattended for very long period of time.

Basic electrical actuators without permanent magnets, such as solenoids and relays, whether powered by AC or DC, operate on the principle of physical attraction between cores magnetized by a coil, and are thus inherently monostable, i.e. limited to a unidirectional power stroke, i.e. in a solenoid from an offset position of the armature (in either direction) to the centered position, and in a relay, from a spring-biased open position to an electrically-powered closed position that holds only as long as sufficient current is maintained in the coil.

It is important to note that it is generally inherent in conventional solenoids and relay type actuators there is a working magnetic flux path set up in an air gap between movable magnetic pole pieces, such that throughout the power stroke both the length of the air gap and the flux density vary substantially from a large gap and low flux density at the "open" end position to small or even zero air gap and maximum flux density at the "closed" end position, and the magnitude of this air gap variation determines length of stroke available, generally limiting the stroke length to only a small fraction of the overall size of the actuator and thus limiting the device to a relatively short stroke.

For use in demanding fields such as in aerospace, missiles and other defense products, as addressed by the present invention, the actuator must provide (1) uniform bidirectional drive power delivering a high transfer force against a substantial load in both directions over a relatively long stroke and (2) positive bistable hold at both stroke-end positions under adverse ambient conditions including high acceleration; there can be no holding power consumption at either stroke end, since there are long periods of time involved in which any power consumption would be unacceptable.

Even when a conventional solenoid or relay structure is modified to make it bistable by departing from the simple structure, e.g. by adding springs, a second coil, and/or permanent magnet(s) to obtain bidirectional actuation, the basic principle of depending on attraction between magnetized pole pieces with variable gap and flux density inherently limits the stroke to an unacceptably short length.

Further background information can be found in allowed U.S. patent application Ser. No. 09/843,478, which is incorporated herein by reference.

DISCUSSION OF KNOWN ART

Practically all known art in this field operates on the magnetic-keeper-attraction principle of electromagnetic operation of solenoids or relays in which the inherent electrical drive is unidirectional and end-holding is monostable, so that these properties must be modified mechanically; e.g. stroke-end holding force in conventional vehicular locks is often implemented by some form of mechanical force, usually from metallic springs in coiled or other form.

Patents showing mono-stable lock actuators utilizing a single solenoid with spring bias are exemplified by U.S. Pat. Nos. 3,576,119, 4,917,419, 4,907429 and 4,679,834.

U.S. Pat. Nos. 5,199,288 and 4,703,637 exemplify actuators that obtain bistable stroke-end positions for locking and unlocking purposes through the use of a rotary electric motor typically utilizing a worm gear engaging a threaded shaft or pinion.

U.S. Pat. No. 5,231,336, by the present inventor, discloses a mono-stable electromagnetic actuator for active vibration control. The magnetic armature of this actuator operates in the voice coil mode to create a linear vibratory motion under the influence of a sinusoidal current through the surrounding coils. A positive current in the coils drives the armature in one direction while a negative current drives the armature in the opposite direction. Removing the current returns the armature to its stable central rest position under influence of the magnetic field and internal springs. This construction is inherently monostable at the center position: it would require radical redesign to provide a stable unpowered armature position on each end of the stroke.

U.S. Pat. No. 4,829,947 by Lequesne for variable lift operation of a bistable electro-mechanical poppet valve actuator discloses an automotive valve actuating device whereby a valve, with attached armature is spring-biased toward a neutral central position but held in a full open or a closed position by permanent magnets having associated coils. Activation of a coil can fully cancel the field of the associated magnet to allow the spring to move the valve to the other position.

U.S. Pat. No. 4,533,890 to Patel discloses a PERMANENT MAGNET BISTABLE ACTUATOR for automotive valves, having a pair of solenoid coils acting on a common central core which requires two coaxial permanent magnets to provide bi-stability.

For actuators in the field of the present invention, two basic parameters are the stroke length and the housing size, which for simplicity can be expressed as the average of the housing diameter and its length. The ratio of stroke length/housing size provides a non-dimensional figure of merit for relative stroke length.

Actuators of known art, whether of the solenoid or other moving armature type that depend on a single mode of electromagnetic actuation for the entire stroke, typically those involving a highly variable air gap, are inherently short stroke actuators with a stroke length under 10% of the average of the housing length and diameter in practical designs.

OBJECTS OF THE INVENTION

It is an object of the present invention to provide an actuator, suitable for locking purposes in missiles, aerospace craft and the like, that is bi-powered and bistable, i.e. providing electrically powered drive force in both directions over a predominant central portion of the stroke, and stable unpowered holding conditions at both stroke-ends, positively stabilized by design-controllable force to withstand designated axial acceleration loading.

It is a further object of the present invention to make the actuator simple and inexpensive and in a basic coaxial form that utilizes a minimum quantity of coils and permanent magnets, preferably only one of each.

It is a further object to provide a long stroke actuator wherein the stroke length exceeds 50% of the housing size defined by the average of the housing length and diameter.

SUMMARY OF THE INVENTION

The aforementioned objectives have been accomplished in the present invention of a bistable actuator in a coaxial plunger-type configuration having a single coil in a shell/yoke surrounding a single armature containing a permanent magnet. The actuator performs its transducing function primarily in the manner and mode of a loudspeaker voice coil, i.e. it is driven to move through a linear stroke by the force from magnetic action on those turns of the current-carrying coil that are at that instant located in the substantially constant magnetic flux path through a radial magnetic gap traversing the coil. In the case of the loudspeaker, the voice coil and cone assembly are suspended as a movable mass portion for purposes of the required vibration, while the PM (permanent magnet) system is made to be the stator, i.e. the fixed mass portion. However, in the present actuator the foregoing loudspeaker structural arrangement is reversed: the magnet is made to be the main part of the movable mass portion, i.e. the armature, and the coil assembly is made to be part of the fixed mass portion, i.e. the shell/yoke/stator, thus avoiding the need for flexible electrical connections that are required in a loudspeaker for connecting the voice coil.

A cylindrical shell serves as a magnetic yoke that cooperates with the armature magnet to provide bistable stroke-end locations of the armature, and that cooperates with the coil and magnet in a manner to motivate actuation between these two stroke-end locations when the coil is powered.

The shell and the bobbin are configured in a special manner that locates the coil in essentially one end half-portion of the shell while a tubular channel formed integrally with the bobbin extends full length of the shell. The tubular channel is dimensioned internally to provide a sliding fit with a pair of circular pole plates one on each end of the magnet, thus guiding the armature-plunger in an axial travel path within a designated stroke length. The armature can be shifted to the opposite end of the stroke by energizing the coil with DC (direct current): the direction of armature movement depends on the DC polarity, so that, as an added advantage, only two terminals and two connecting wires are required.

For all armature locations within the main central portion of the stroke range, the rim of one of the circular pole plates on the magnet forms a primary working magnetic air gap of substantially constant pole-face separation from the inside surface of the shell, with the radial PM flux from the magnet acting on the turns of the coil in that region. The PM flux path returns through a secondary magnetic air gap between the rim of the other circular pole plate at the opposite end of the magnet, and a region of the shell that is stepped down to a substantially smaller inside diameter in that end portion so as to maintain a constant separation and PM flux density at the secondary return magnetic gap, so that the actuator functions primarily in a voice-coil mode over the main central portion, i.e. about 90%, of the stroke, and transitions to a magnet-keeper-attraction mode at the stroke-end regions for bi-stability.

The stable PM attraction forces in the two stroke-end positions can be controlled in design by area of contact and thickness of the soft iron pole pieces, the shell-to-pole plate spacing, and/or the optional introduction of a controlled-thickness spacer of non-magnetic material at either end.

BRIEF DESCRIPTION OF THE DRAWINGS

The above and further objects, features and advantages of the present invention will be more fully understood from the following description taken with the accompanying drawings in which:

FIG. 2A depicts the essential magnetic components of the actuator of FIG. 1A showing the path of the PM flux loop that holds the armature at the retracted stroke-end.

FIG. 2B shows the items of FIG. 2A and the PM flux loop path with the armature in motion toward the right, having moved away from the stop-face by a small portion of the stroke in response to energizing the coil.

FIG. 2C depicts the items of FIG. 2B with the armature continuing in motion as it approaches the right hand stroke-end.

FIG. 2D depicts the items of FIG. 2C with a branch of the PM flux loop holding the armature at the right hand stroke-end.

DETAILED DESCRIPTION

Figure 1A:
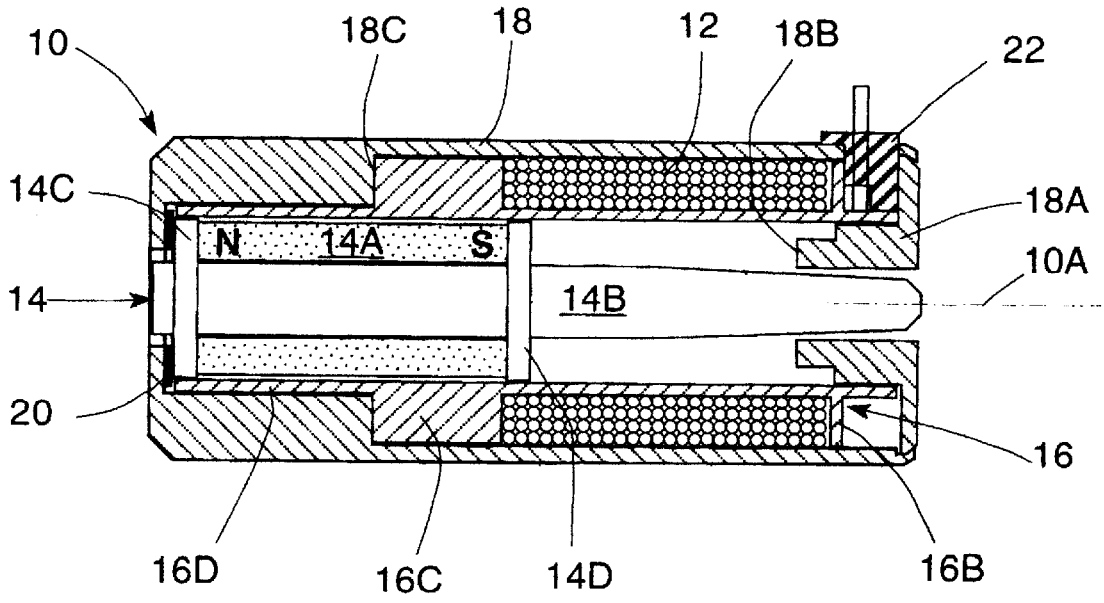
FIG. 1A is a cross-sectional view of an actuator illustrating a preferred embodiment of the present invention, showing the armature disposed at a stabilized retracted stroke-end location.

FIG. 1A, a cross-sectional view of an actuator 10, illustrates a preferred embodiment of the present invention: a single stator coil 12 cooperates with a single moving armature 14 that includes mainly a permanent magnet 14A with N and S pole plates 14B and 14C that is free to move axially in the manner of a plunger.

Bobbin 16 is formed from non-magnetic material, which could be metal or plastic, to provide two support walls for the ends of coil 12: a relatively thin wall 16B at right end of coil 12 as shown, and a spacer 16C at left end of coil 12 that serves to support coil 12 at that end and also to provide a spacer of non-magnetic material in the off-center region shown. The length of spacer 16C is allocated in design to optimize the transition of the actuator between the powered voice-coil type actuation mode and the unpowered PM stroke-end holding mode, and to achieve the holding force performance required at each of the two stroke-end regions. Typically this length is made substantially less than half the stroke length. Beyond the spacer 16C, to the left as shown, the shape of bobbin 16 once again reverts to that of the thin-walled guidance tube portion 16D extending to the left hand end. The components of actuator 10 are enclosed in a generally cylindrical shell 18 and end cover 18A of soft iron, forming a magnetic yoke.

End cover 18A is configured to act as a bushing for lock pin 14B and internally as an end-stop that limits the armature stroke. Shell 18 is made with relatively thin wall thickness in the region of coil 12 and 16C, beyond which toward the left as shown, at step 18C the shell 18 is increased in thickness to extend to the bobbin tube portion 16D so as to form a secondary magnetic air gap in cooperation with the rim of pole plate 14C that acts to complete the return of the flux in the flux loop path. The left hand end of shell 18 is shaped as shown to form a stop-face that limits the travel of armature 14 at that end of the stroke.

The strength of the PM stroke-end holding force at the stroke-end positions can be controlled by tailoring the size of the end-contact area at the armature pole-plate as indicated by the reduced effective outer diameter shown at the right-hand end in FIG. 1A. Due to effects on both total flux and flux density, the mathematical function of this force versus end-contact area exhibits a maximum value at a particular optimal area: above and below this optimal area the force decreases, becoming low for very large or very small end areas.

Alternatively, this stroke-end holding force can also be controlled by a shim 20 of non-magnetic material, interposed at either end, as shown at the left hand end in FIG. 1A. Furthermore thin soft washers could be added at one or both ends for silencing purposes.

Pin 14B is made of non-magnetic material typically non-ferrous metal, and, in the illustrative embodiment, is made to extend entirely through a central channel in magnet 14A as shown.

At the right hand end as shown, an end cover 18A provides a bushing for the pin 14B and retains an electrical connector 22. Apart from connector 22, generally all components of actuator 10 are coaxial, being concentric about a central axis 10A.

Figure 1B:
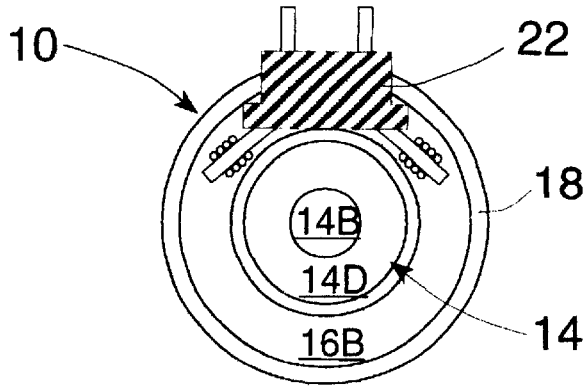
FIG. 1B is a view of the right hand end of the actuator of FIG. 1A with the end cover removed.
Figure 2A:
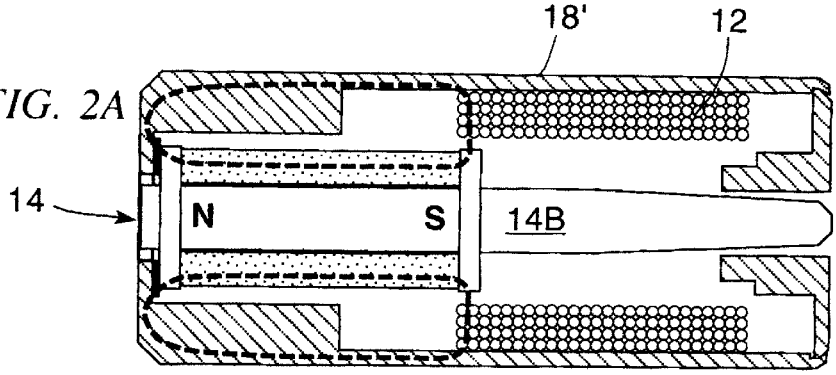
FIGS. 2A–2D are cross-sectional views of the coil, yoke and armature as the three main functional magnetic components of the actuator of FIGS. 1A and 1B, showing the predominant path of the PM flux loop for each of a sequence of four different armature locations within its total stroke.

FIG. 1B, the right hand end view of the actuator of FIG. 1A with cover 18A removed, shows the coaxial nature of the structure: the coil end support wall 16B is visible along with the end view of pin 14B and magnet pole-plate 14D of armature-plunger 14. The two-pin electrical connector 22 is connected to the coil winding FIG. 2A shows the three main functional components of the actuator: coil 12 armature 14 and yoke 18', formed by shell 18 and cover 18A (FIG. 1A), with the armature 14 shown at the left stroke-end location, where it is magnetically held by the magnet's flux loop of which the predominant path is shown as the dashed lines. At this location with no electrical power applied to coil 12, the armature 14 is held against the left hand stop-face with magnetic attraction due to the force of the magnetic flux loop as shown in dashed lines through the magnet and the yoke 18' acting in the well-known magnet-to-keeper attraction manner that exerts force in a direction that seeks to minimize the spacing of air gaps involved and to thus maximize the flux density, thus urging the armature 14 toward the left holding it in place in the stroke-end location shown, holding the lock pin 14B in its retracted disposition.

The actuator 10 of the present invention differs radically from ordinary relay and solenoid type actuators in that actuator 10 functions in the mode and manner of a loudspeaker voice coil being configured such that the radial gap separation and the density of the radial flux lines at the pole faces formed by the rims of both the N and S pole plates remain substantially constant while armature 14 travels through practically the full range of the stroke, apart from effects due to the magnetic stabilization in the two extreme stroke-end regions.

When correctly-polarized DC is applied to the winding in coil 12, a coil force is developed between the current-carrying wires of coil 12 and the PM flux lines extending radially within the air gap bounded by the rim of the S pole plate of the armature 18 and the inner shell surface. The coil force acts in a direction to overcome the previously-described magnetic stroke-end holding force and acts on the armature 14 to move it to the right. The direction of the coil force is in accordance with the fundamental right hand rule of electromagnetic theory, also known as Fleming's rule, which relates the directions of magnetic flux and current flow in a wire, which in turn dictates the direction of the resultant force on the wire, which in this case reacts on and moves the armature 14, when current is applied to the wire turns of coil 12 due to the radial PM field that is always present at some partial region of coil 12 for all locations within the armature stroke.

At the initiation of the stroke, with the armature 14 located at the stroke-end as shown in FIG. 2A, the aforementioned voice-coil actuating effect is made strong enough to overcome the magnetic attraction that acts in the unpowered condition, causing armature 14 to separate from its stop-face and move toward the right as the voice-coil mode takes over for the rest of the stroke.

Figure 2B:
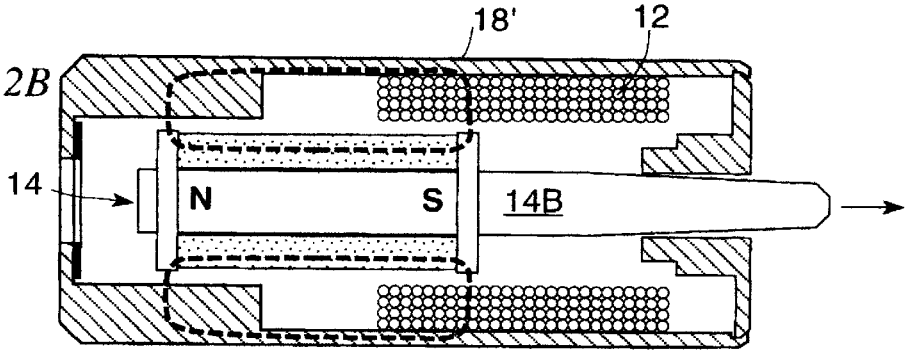

FIG. 2B shows a "freeze-frame" of the actuator with the armature 14 in motion to the right as indicated by the arrow, having separated from the left hand stroke-end as previously described in connection with FIG. 1A and entered the voice coil mode of actuation where the magnetic flux in the gap at the S pole plate traversing the coil turns as shown propels the armature 14 to the right, with the flux path returned through the other gap at the rim of the N pole plate, both gaps remaining substantially constant in separation distance, and thus the flux density remaining constant over the major portion of the stroke, as armature 14 moves to the right.

Figure 2C:
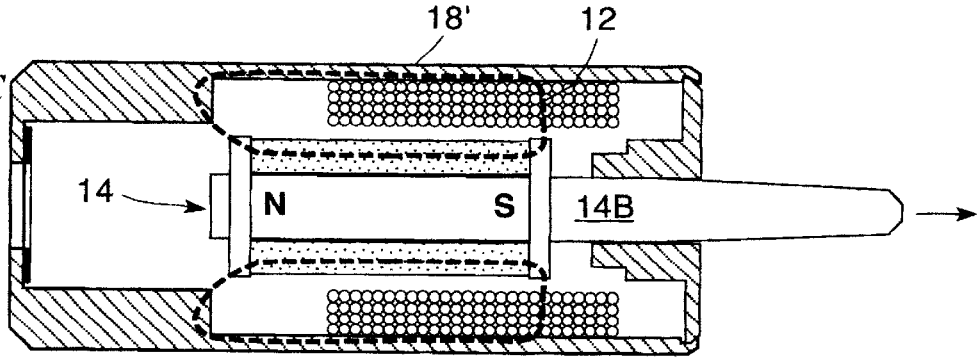

FIG. 2C shows a "freeze-frame" sequential to that of FIG. 2B, with armature 14 having moved to the right and approaching the completion of its stroke. The motive force at the S pole plate continues, however there will be some reduction of the PM flux density due the increasing gap-width at the N pole plate caused by the non-magnetic space to the left of the coil 18; at this point a PM attractive force begins to also act on the armature 14 as the S pole plate at right approaches the right hand stop-face.

Figure 2D:
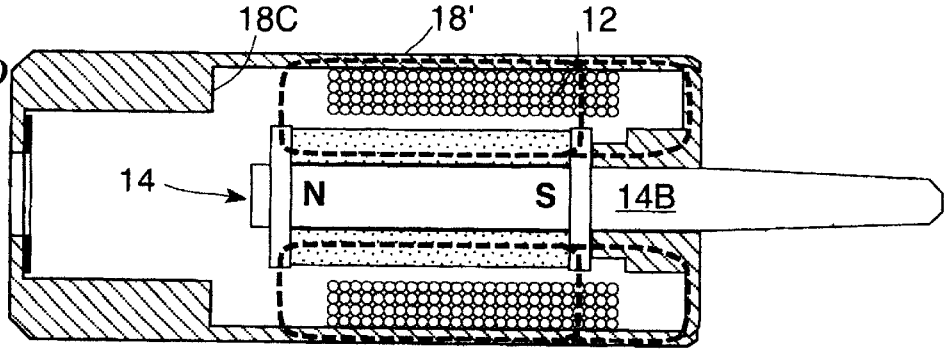

In FIG. 2D, with armature 14 having reached the right-hand end stop-face location, the flux loop path has split into two branches, one branch traversing coil 12, and the other branch going through the end cover portion of yoke 18' and the right-hand stop-face which produces the stroke-end magnetic holding force.

In this condition, axial force contributed by the N pole plate is essentially neutral: the return gap remains practically constant with armature movement in the extreme stroke-end region since the main flux path has been diverted to the thin shell region as shown due to the further separation from step 18C, compared to the condition in FIG. 2C. The non-magnetic space provided to the left of coil 12 serves to introduce a gap into the flux loop path in this stroke-end condition that is somewhat equivalent to the gap occupied by the coil 12 at the opposite stroke-end condition as seen in FIG. 2A. In design, the dimensioning of these gaps influences the holding force performance at each of the two stroke-ends.

Upon de-powering coil 12 at this point, the armature 14 remains firmly held by the PM magnetic holding force, since any attempt to separate the S pole plate of armature 14 from the yoke pole face formed by cover 18A will be strongly opposed by the magnetic force that reacts against any "keeper" displacement that would tend to decrease the PM flux density.

In this stroke-end position, with no DC applied to coil 12, the S pole of magnet 14A is attracted to the stop-face in end cover 18A by the flux loop returned through the shell thus holding the armature 14 in this position with the lock pin 14B fully extended.

The reverse stroke is accomplished by applying DC to coil 12 in the opposite direction so that the resultant force exerted at the region of coil 12 traversed by the flux loop portion now overcomes the PM stroke-end holding force and moves armature 14 to the left. Upon end-stop separation the portion of flux path in the end cover quickly diminishes as it is diverted back to add to the portion traversing coil 12 until this becomes the entire flux path again as in FIG. 2C. Thus the armature 14 moves to the left through the full reverse stroke until once again the armature 14 becomes held magnetically at the left stroke-end position as in FIGS. 1A and 2A with lock pin 14B retracted, and thereupon the DC can be removed from coil 12.

Nominal specifications for an exemplary embodiment of the invention are as follows:

Outside diameter of shell: 0.425"

Length of shell: 1.0"

Location of shell step: 0.7" from cover end

Outside diameter of magnet pole plates: 0.21"

Length of magnet and pole plates 0.4"

Length of stroke: 0.35"

Time period of stroke: <10 milliseconds

D.C. supply voltage: 50 volts

Coil resistance: 14 ohms

Stroke drive force: 700 grams

Stroke-end holding force (a) extended: 600 grams (b) retracted: 100 grams

Weight of armature: 1.7 grams

Total weight of actuator: 11 grams

From the foregoing specifications it can be calculated that the long stroke length achieved is approximately 35% of the housing length, 82% of the housing diameter, and 58.5% of the average of the housing length and its diameter.

The invention may be practiced in other implementations that also operate primarily according to the voice coil principle while utilizing magnetic holding force to make the actuator bistable by holding the armature so as to prevent relative movement at either of the two stroke-ends, in the absence of DC in the coil, e.g. by utilizing more than one coil and/or more than one permanent magnet.

As an alternative to the coil-stator and magnet-armature configuration disclosed as the illustrative embodiment, the invention could be practiced utilizing an inverse structure with the coil incorporated in the armature and the magnet incorporated in the stator. Such structure would have the disadvantage of requiring flexible leads or other special connections to accommodate the movement of the armature over its full stroke.

The shell could be made with a removable end cover at either or both ends.

The shell as described above can be machined from solid cylindrical or tubular stock, typically soft iron, to have a uniform outside diameter and stepped internally to provide the two portions with different inside diameters as shown. Alternatively it could be further machined or else made by casting or press-forming to have substantially constant wall thickness, and stepped both internally and externally between the two portions having different diameters outside as well as inside, to accomplish material and weight savings.

The locking pin could be attached to an end of the armature rather than extend through it as shown, and could be extended in the opposite direction instead of or in addition to the end shown. Instead of a tapered locking pin as shown the armature could be coupled to an external mechanism by a drive shaft or other mechanical linkage.

The characteristic of the magnetic holding performance obtained at the two stroke-ends by providing the non-magnetic space adjacent to the coil could be accomplished in a different manner, for example by the sizing of the magnetic contact area at the stop-face and/or introducing a suitable non-magnetic spacer at each stroke-end stop-face. Various kinds of shims, spacers, and/or bushings could be provided in end covers or integral end structure at either or both ends of the shell, and modified in a manner to independently control the strength of bistable holding force provided at each end.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A bistable long stroke electromagnetic actuator, comprising:

only one electrical coil of wire turns, wound on an annular bobbin of non-magnetic material, forming with the bobbin a coaxial coil assembly, affixed in a first mass portion of said actuator and configured with an open cylindrical coaxial passageway;

only one permanent magnet, producing a magnetic field of flux lines, located coaxially and secured in a second mass portion of said actuator, the second mass portion being made and arranged to be slidingly movable relative to the first mass portion, in a stroke of axial direction and predetermined length;

a magnetic yoke system, made and arranged to conduct a preponderance of the flux lines in a flux loop path that traverses said permanent magnet in series with said yoke system, the flux loop path including a primary working magnetic air gap of predetermined separation distance, maintained substantially constant over a major central portion of the stroke, interposed in series in the flux loop path, providing a region of high flux density traversing a portion of said coil, such that an electrical current applied to the coil winding causes a mechanical force to act on the winding portion located in the magnetized gap in a defined direction perpendicular to the wire turns in accordance with well known electromagnetic physics, the defined direction being made to substantially coincide with the designated stroke direction, said magnetic yoke system being made and arranged to cause said coil and said magnet to respond to current of a first polarity and of sufficient amplitude by relative movement between said magnet and said coil, so as to drive a designated driven mechanical payload, within the stroke length from a first stroke-end to a second and opposite stroke-end; and conversely, to respond to such current in a second and opposite polarity by moving from the second stroke-end to the first stroke-end; and guidance means made and arranged to confine the relative movement between the two mass portions to a substantially straight line stroke path;

said magnet and said yoke system being made and arranged to cooperate in a manner to magnetically hold the first and second mass portions together as a common mass at each the two stroke-ends with said coil unpowered and thus provide bi-stability.

2. The bistable long stroke electromagnetic actuator as defined in claim 1 wherein:

the first mass portion of said actuator comprises a generally tubular soft iron shell containing said coil winding and said bobbin disposed coaxially in the shell extending from an end region to a mid region thereof; and the second mass portion of said actuator constitutes a generally cylindrical armature comprising a generally cylindrical permanent magnet having poles at first and second opposite ends thereof respectively, the ends being configured coaxially with corresponding first and second soft iron pole plates, each having a circular rim.

3. The bistable long stroke electromagnetic actuator as defined in claim 2 wherein the shell constitutes a cylindrical housing of designated diameter and designated length not including the driven mechanical payload, and wherein the stroke length exceeds 25% of the housing length, 75% of the housing diameter and 50% of the average of the housing length and the housing diameter.

4. The bistable long stroke electromagnetic actuator as defined in claim 3 wherein the designated driven mechanical payload comprises an extended end region of the movable second mass portion configured and arranged to extend beyond the housing upon actuation so as to constitute a retractable locking pin.

* * * * *